United States Patent [19]

Yamamoto

[11] Patent Number: 4,790,485

[45] Date of Patent: Dec. 13, 1988

[54] GUN HEAD FOR POWDER PAINTING

[75] Inventor: Masahiro Yamamoto, Sakura, Japan

[73] Assignee: Onoda Cement Company, Ltd., Yamaguchi, Japan

[21] Appl. No.: 17,351

[22] Filed: Feb. 24, 1987

[30] Foreign Application Priority Data

Mar. 6, 1986 [JP] Japan ..... 61-049293

[51] Int. Cl.[4] ..... B05B 5/00; B05B 15/04; B05B 1/14; B05B 1/26

[52] U.S. Cl. ..... 239/707; 239/515; 239/543; 239/568

[58] Field of Search ..... 239/696, 706, 707, 708, 239/548, 567, 433, 601, 704, 543, 544, 513, 514, 515, 506, 455, 456, 568, 505, 516, 533.13, 602, 519

[56] References Cited

U.S. PATENT DOCUMENTS

| | | | |
|---|---|---|---|
| 1,230,982 | 6/1917 | Barber | 239/543 |
| 1,977,406 | 10/1934 | Powell | 239/601 |
| 2,130,629 | 9/1938 | Clayton | 239/552 |
| 2,856,236 | 10/1958 | Hunziker | 239/515 |
| 3,219,276 | 11/1965 | Norris | 239/292 |
| 3,263,127 | 7/1966 | Point et al. | 239/707 |
| 3,698,636 | 10/1972 | Szasz | 239/518 |
| 4,494,699 | 1/1985 | Hengesbach | 239/514 |
| 4,607,794 | 8/1986 | Horwood | 239/512 |

FOREIGN PATENT DOCUMENTS

| | | | |
|---|---|---|---|
| 577357 | 5/1946 | United Kingdom | 239/292 |
| 692233 | 4/1951 | United Kingdom | 239/602 |

*Primary Examiner*—Andres Kashnikow
*Assistant Examiner*—Chris Trainor
*Attorney, Agent, or Firm*—Price, Heneveld, Cooper, DeWitt & Litton

[57] ABSTRACT

A gun head constituting the front section of an electrostatic powder painting gun makes the pattern of powder flow spouted out therefrom into the form of a flat fan-like shape to decrease the velocity of the powder flow traveling toward a workpiece to be painted to thereby enhance the efficiency of adhesion of the powder paint to the workpiece. A spout section of an end wall of a cylindrical body constituting a fundamental section of the gun head has a pair of opposed slits bored therein such that the spacing between these slits decreases progressively as approaching the outer ends thereof, and the inner ends of these slits communicate with a powder path formed inside the cylindrical body at opposed spots close to the inner surface of the powder path.

4 Claims, 2 Drawing Sheets

GUN HEAD FOR POWDER PAINTING

FIELD OF THE INVENTION

This invention relates to a gun head of an electrostatic powder painting gun and, more particularly, to an improvement of the gun head of the powder painting gun for spouting out a flow of powder in the form of a flat fan-like shape, which is adapted to paint a planar workpiece, especially, each inner surface of a pair of opposed plates constituting a louver-like workpiece.

DESCRIPTION OF THE PRIOR ART

A conventional gun head for powder painting of the aforementioned type has a single slit formed in its spout section, and the inner end of this slit is communicated with a powder path provided inside a nozzle at a central portion of the powder path. Consequently, the powder flowing through the central portion of the powder path inside the nozzle at comparatively high speeds toward the spout section passes through the slit while assuming the same direction as before, but, its sectional area is narrowed by the slit.

Accordingly, the spouting velocity at the spout port becomes remarkably high to thereby deteriorate the adhesion/diffusion property of the powder paint with respect to the workpiece.

The aforementioned type of gun head having the slit in the spout section can make the spout pattern of the powder into the form of a flat fan-like shape. However, reversely, this type involves a critical drawback as described above if used as the powder painting gun. Thus, in the type of gun head equipped with the slit, it was deemed to be difficult to lower the spouting velocity.

SUMMARY OF THE INVENTION

The object of the present invention is to overcome the foregoing drawback of a gun head having a slit formed therein, thus, to prevent an increase of the spouting velocity of a powder paint to thereby enhance the adhesion/diffusion property of the powder paint with respect to a workpiece to be painted.

In brief, according to the present invention, a spout section of an end wall of a cylindrical body has a pair of opposed planar slits bored therein such that the spacing between these slits decreases progressively as approaching their outer ends from their inner ends, these inner ends are communicated with a powder path formed inside the cylindrical body or a nozzle at opposed spots close to the inner surface of the powder path, and these outer ends or distal ends are parallel to each other on the outer end surface of the end wall.

A carrier air and a powder paint flowing through the powder path provided inside the cylindrical body toward the spout section flow each separately into the respective inner ends of the paired slits opened at opposed spots close to the inner surface of the powder path, and are changed into spouting flows traveling from the outer ends of these slits toward a workpiece.

After leaving the outer ends these spouting flows intersect with each other in the external to expand flat to thereby create the pattern of a fan-like shape as a whole.

Since each spouting flow going from the distal end or outer end of a respective slit toward the external intersects and collides with the other and then disperses and expands so as to assume a fan-like shape, the spouting velocity of the whole pattern traveling toward the workpiece decreases remarkably as compared with the case where no collision is implemented.

DESCRIPTION OF THE PREFERRED EMBODIMENTS

Figure 1:
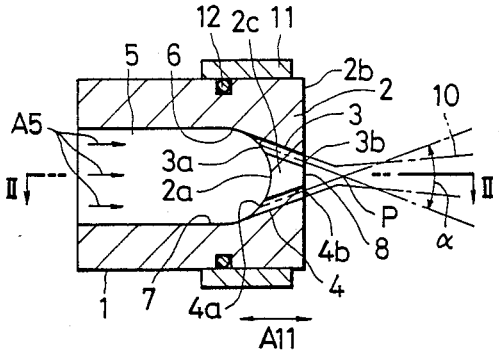
FIG. 1 is a vertical sectional view of a first embodiment of the present invention.

A first embodiment of the present invention will first be described with reference to FIGS. 1 and 2. In an end wall 2 of a cylindrical body 1 is bored a pair of opposed planar slits 3 and 4. The spacing between these slits decreases gradually as going from their inner ends 3*a* and 4*a* toward their outer ends 3*b* and 4*b*. The inner ends 3*a* and 4*a* of the slits 3 and 4 are communicated with a powder path 5 formed inside the cylindrical body 1 at opposed spots 6 and 7 close to the inner surface of the powder path. The outer ends 3*b* and 4*b* of the slits 3 and 4 are made parallel to each other on an outer end surface 2*b* of the end wall 2.

A portion of the end wall 2 existing between the paired parallel outer ends 3*b* and 4*b* defines a partition section 2*c* of the slits 3 and 4.

A powder paint flows inside the powder path 5 in the direction of the arrows A5 together with a carrier air, each part of the powder passing by either opposed spot 6 or 7 close to the inner surface of the powder path 5 flows through the inner end 3*a* or 4*a* into the slit 3 or 4 in the same direction as before, and then is spouted out from the outer end 3*b* or 4*b*.

Spouting flows of a pair outgoing from the outlets or outer ends 3*b* and 4*b* collide with each other at a downstream position P behind an outer end surface 8 of the partition section 2*c* which is a part of the end wall 2 with an intersection angle $\alpha$ of the pair of slits 3 and 4. The resultant spouting flow expands flat and creates a fan-like pattern 10 as a whole.

Therefore, the flow departing from the outer ends 3*b* and 4*b* toward the external decreases its spouting velocity after collision and travels toward a workpiece.

On the outer periphery of the cylindrical body 1 is, slidably in the directions of the arrow All and clampably mounted, an outer cylinder 11 for adjusting the extent of expansion of the flat pattern 10 via rubber ring 12.

An inner end surface 2a of the powder path 5 is a curved concave surface looking inward, hence, a part of the powder flowing into a central portion of this concave surface turns round and is agitated, and after passing by the spots 6 and 7 close to the inner surface, arrives at the inner ends 3a and 4a of the slits 3 and 4.

Figure 4:
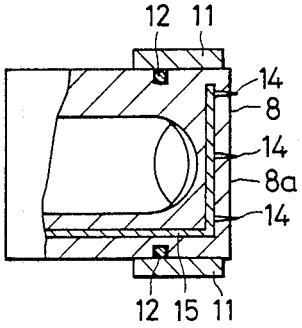
FIG. 4 is a vertical sectional view of a second embodiment, corresponding to FIG. 1.

A second embodiment is shown in FIG. 4. This second embodiment differs from the first embodiment shown in FIGS. 1 and 2 in that on the outer end surface 8 of the partition section 2c of the slits 3 and 4 are projected the pointed ends of needle-like electrodes 14, and the base sections of these needle-like electrodes 14 are connected with a conductor 15 embedded in the insulating cylindrical body 1 made, for example, of synthetic resin.

The other configurations not mentioned above are the same as in the first embodiment. Electric lines of force running from the needle-like electrodes 14 toward the workpiece intersect with the powder flow spouted out from the outer ends 3b and 4b of the planar slits 3 and 4 to electrify the powder.

By adequately selecting the resistance of the conductor 15 it is possible to make the conductor possess the function of a protective resistor.

Figure 2:
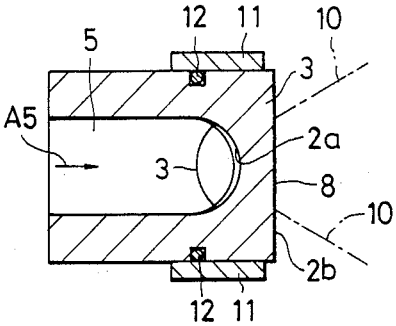
FIG. 2 is a sectional view taken along line II—II of FIG. 1.
Figure 3:
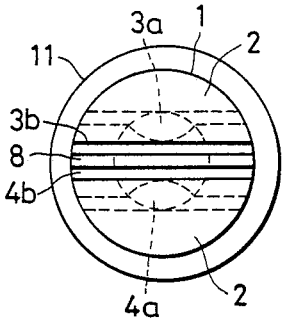
FIG. 3 is the right-hand side view of FIG. 1.
Figure 5:
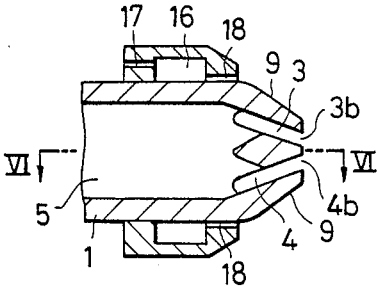
FIG. 5 is a vertical sectional view of a third embodiment.
Figure 6:
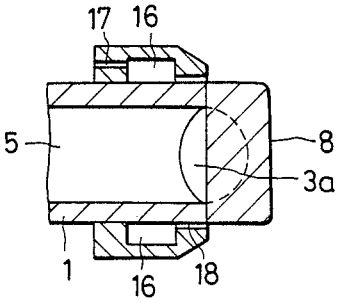
FIG. 6 is a sectional view taken along line VI—VI of FIG. 5.
Figure 7:
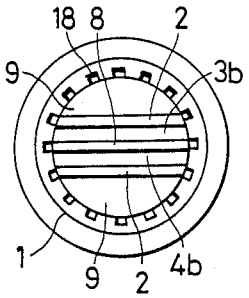
FIG. 7 is the right-hand side view of FIG. 5.

A third embodiment shown in FIGS. 5, 6, and 7 differs from the first embodiment shown in FIGS. 1 through 3 in that in place of making the shape of the outer end surface 2b level and circular, the outer ends 3b and 4b of the slits define a peak and both sides of the peak define inclined surface 9, whereby a tapered flat mountain-like appearance is provided. Further, around the outer periphery of the cylindrical body 1 is provided an annular air chamber 16 which has an air inlet 17 bored on the upstream side and a plurality of air outlets 18 bored on the downstream side. Pressurized air is introduced through the air inlet 17 into the annular air chamber 16 and ejected downstream through each air outlet 18, whereby the pattern of the powder flow spouted out from the outer ends 3b and 4b of the slits 3 and 4 is covered over the whole periphery from the outside.

In operation, by regulating the ejecting velocity of the air from the air outlets 18, the extent of expansion of the pattern of the powder flow can arbitrarily be adjusted.

Figure 8:
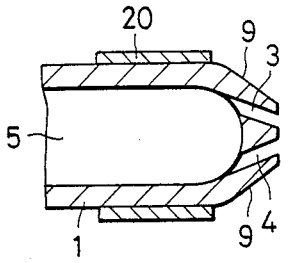
FIG. 8 is a vertical sectional view of a fourth embodiment.
Figure 9:
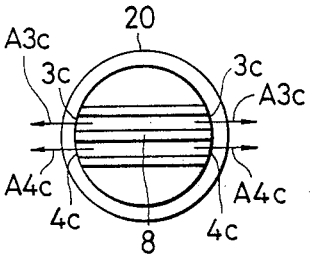
FIG. 9 is the right-hand side view of FIG. 8.

A fourth embodiment shown in FIGS. 8 and 9 includes a pattern adjusting cylinder 20 made of elastic material, such as rubber, and fitted on the cylindrical body 1. The elasticity is effective to secure the cylinder to a given position under pressure.

When the pattern adjusting cylinder 20 is positioned as shown, both side ends 3c and 4c of the planar slits 3 and 4, as well as their outer ends 3b and 4b, are opened. Thus, the powder is ejected also through these side ends in the directions of the arrows A3c and A4c, so that the extent of expansion of the fan-like pattern becomes large.

Incidentally, the elements of FIGS. 8 and 9 designated by the same reference numerals as used in FIGS. 1 through 7 are identical in reference name and function with those of the first through third embodiments.

Figure 10:
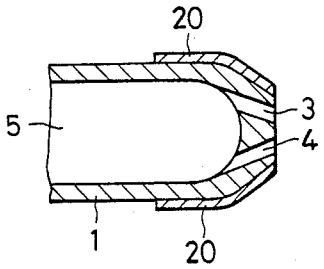
FIG. 10 is a vertical sectional view of the fourth embodiment shown in FIG. 8 with one element displaced.
Figure 11:
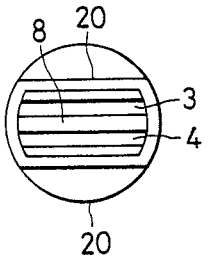
FIG. 11 is the right-hand side view of FIG. 10.

FIGS. 10 and 11 also show the fourth embodiment of FIGS. 8 and 9, but differ therefrom in that the position of the pattern adjusting cylinder 20 is shifted toward the distal end of the head. In the thus attained condition, the pattern adjusting cylinder 20 deforms due to its elasticity so as to accord in shape with the flat section of the cylindrical body 1 and covers the outlet side ends 3c and 4c of the slits 3 and 4, so that the powder cannot be spouted out through these side ends.

Accordingly, the fan-like pattern of the powder flow is restricted narrow in the extent of expansion.

Of course, the reference numerals shown in FIGS. 10 and 11 are the same as in FIGS. 8 and 9.

Figure 12:
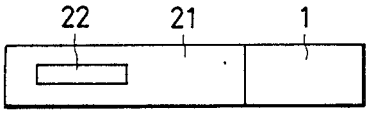
FIG. 12 is a side view of a powder painting gun having a gun head, which may be the first, or third, or fourth embodiment of the present invention, attached to its gun body.

FIG. 12 shows a powder painting gun which is a combination of a gun body 21 including an electrifying unit 22, and a cylindrical body 1 such as of the gun head shown in FIGS. 1 through 3 or in FIGS. 5 through 11 which is devoid of the needle-like electrodes projecting on the outer end surface. In this structure, the powder passing through the aforementioned powder path 5 is pre-electrified by the electrifying unit 22 and sent into the head of the present invention, and then spouted out from the outer ends toward the workpiece.

Figure 13:
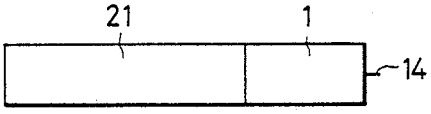
FIGS. 13 and 14 are side views of the powder painting gun having the gun head of the second embodiment attached to the gun body.

FIG. 13 shows another structure wherein the body 21 including no electrifying unit is combined with the cylindrical body 1 of the gun head having the needle-like electrodes 14 provided on the outer end surface 2b or 8. The powder not electrified within the powder path 5 is introduced into the cylindrical body 1 of the gun head, electrified by the needle-like electrodes 14 when spouted out from the outer ends 3b and 4b of the paired slits, and driven toward the workpiece by means of an electric field created between these needle-like electrodes 14 and the workpiece not shown.

Figure 14:
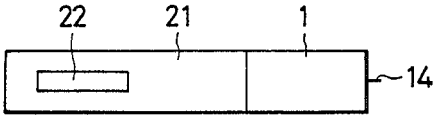

FIG. 14 shows a further powder painting gun which is a combination of the gun body 21 including the electrifying unit 22 and the cylindrical body 1 of the gun head equipped with the needle-like electrodes 14. The powder electrified by the electrifying unit 22 is sent through the powder path 5 into the respective slits 3 and 4, and spouted out from the distal ends 3b and 4b of the slits toward the workpiece.

As described above, according to the present invention, the powder flowing through the central portion within the powder path toward the end wall impinges on the curved concave surface or the inner end surface of the end wall and turns round. Then, the powder is mixed with its carrier fluid while going to the inner ends 3a and 4a of the slits opened at opposed spots close to the inner surface, so that some nonuniformity of the powder which is unavoidable because the powder is conveyed by the air through the powder path 5 can be removed and a certain uniformity can be recovered.

The thus uniformalized powder is ejected from the outer end of each slit while maintaining a planar shape in pattern. Immediately thereafter, each planar powder flow collides with the other obliquely.

After collision, the resultant powder flow dispenses along a plane including that collision plane to thereby assume a flat fan-like pattern.

Due to the phenomena of collision and dispersion occurred as above, the velocity of the powder flow traveling toward the workpiece decreases, so that the adhesion/diffusion property with respect to the workpiece can be enhanced.

What is claimed is:

1. A gun head for powder painting comprising a cylindrical body having a peripheral wall defining an internal powder path and an end wall having a pair of opposed slits formed therein such that the spacing between said slits gradually decreases from their inner ends toward their outer ends, and said inner ends communicate with said powder path within said cylindrical body at opposed locations close to the inner surface of said peripheral wall which surrounds said powder path, said slits having side ends extending through said said peripheral wall of said cylindrical body and said gun head further including a pattern adjusting cylinder surrounding said peripheral wall of said cylindrical body and a rubber ring between said cylinder and said body, said pattern adjusting cylinder positioned inwardly of said end wall and axially moveable along the axis of said cylindrical body to selectively cover portions of said outer ends to adjust the effective width of said slits and the elasticity of said rubber ring being capable of retaining said cylinder in a desired axial position.

2. A gun head for powder painting according to claim 1, wherein the outer end surface of said end wall of said cylindrical body has a needle-like electrode projecting thereon.

3. A gun head for powder painting comprising a cylindrical body having a peripheral wall defining an internal powder path and an end wall having a pair of opposed slits formed therein such that the spacing between said slits gradually decreases from their inner ends toward their outer ends, and said inner ends communicate with said powder path at opposed locations close to the inner surface of said peripheral wall which surrounds said powder path, said slits having side ends extending through said peripheral wall of said cylindrical body, and said gun head further including a pattern adjusting cylinder made of soft elastic material surrounding said peripheral wall of said body and held in a desired axial position by the elasticity of said material, said cylinder positioned inwardly of said end wall and axially moveable along the axis of said cylindrical body to selectively cover portions of said outer ends to adjust the effective width of said slits.

4. A gun head for powder painting comprising a cylindrical body having a peripheral wall defining an internal powder path and an end wall, said peripheral wall having a tapered end portion defined by a surface converging toward said end wall and said end wall having a pair of opposed slits formed therein such that the spacing between said slits gradually decreases from their inner ends toward their outer ends, and said inner ends communicate with said powder path at opposed locations close to the inner surface of said peripheral wall which surrounds said powder path, said slits having side ends extending through said tapered end portion, and said gun head further including a pattern adjusting cylinder made of soft elastic material surrounding said peripheral wall of said body and held in a desired axial position by the elasticity of said material, said cylinder being axially moveable along the axis of said cylindrical body to selectively cover portions of said outer ends of said slits to adjust the effective width of said slits

* * * * *